US008761632B2

(12) United States Patent
Ichikawa et al.

(10) Patent No.: US 8,761,632 B2
(45) Date of Patent: Jun. 24, 2014

(54) IMAGE FORMING APPARATUS AND ROTARY DEVELOPING DEVICE

(75) Inventors: Tomoya Ichikawa, Kanagawa (JP); Yuri Takeuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 211 days.

(21) Appl. No.: 13/469,315

(22) Filed: May 11, 2012

(65) Prior Publication Data

US 2013/0156467 A1 Jun. 20, 2013

(30) Foreign Application Priority Data

Dec. 15, 2011 (JP) ..... 2011-274493

(51) Int. Cl.
*G03G 21/00* (2006.01)
*G03G 15/01* (2006.01)

(52) U.S. Cl.
CPC .... *G03G 15/0126* (2013.01); *G03G 2215/0177* (2013.01)
USPC ..... 399/98; 399/227

(58) Field of Classification Search
CPC ..... G03G 15/0126; G03G 21/0047; G03G 2215/0177; G03G 2221/0078
USPC ..... 399/98, 99, 227, 356
See application file for complete search history.

(56) References Cited

U.S. PATENT DOCUMENTS 4,782,360 A * 11/1988 Iwamoto et al. ..... 399/227
6,201,939 B1 * 3/2001 Yamamoto et al. ..... 399/99
8,311,458 B2 * 11/2012 Tanaka ..... 399/227

FOREIGN PATENT DOCUMENTS

JP 2000-298384 A 10/2000

* cited by examiner

*Primary Examiner* — David Gray
*Assistant Examiner* — Gregory H Curran
(74) *Attorney, Agent, or Firm* — Sughrue Mion, PLLC

(57) ABSTRACT

An image forming apparatus includes an image carrier that holds a toner image, a rotary developing device including a plurality of developing units to develop an electrostatic latent image on the image carrier with toner by supplying the toner from the developing unit opposing the image carrier, a foreign-substance receiving plate that receives a falling foreign substance, a transfer unit that transfers the toner image from the image carrier onto a recording medium, and a fixing unit that fixes the transferred toner image on the recording medium. Each of the developing units includes a developer container that stores developer containing magnetic carriers and toner, and a developing roller that supplies the toner in the developer for development of the electrostatic latent image. The rotary developing device further supports a foreign-substance collecting member that magnetically collects a magnetic foreign substance on the foreign-substance receiving plate.

19 Claims, 4 Drawing Sheets

IMAGE FORMING APPARATUS AND ROTARY DEVELOPING DEVICE

CROSS-REFERENCE TO RELATED APPLICATIONS

This application is based on and claims priority under 35 USC 119 from Japanese Patent Application No. 2011-274493 filed Dec. 15, 2011.

BACKGROUND (i) Technical Field

The present invention relates to an image forming apparatus including a rotary developing device, and the rotary developing device.

(ii) Related Art

There are known image forming apparatuses each including a rotary developing device in which a plurality of developing units arranged around a rotation shaft are revolved around the rotation shaft to move a developing unit used for a current developing operation to a developing position. In some of such image forming apparatuses, a foreign-substance receiving plate is provided in a lower part of the rotary developing device to receive falling foreign substances, such as developer, falling from the rotary developing device.

In general, foreign metallic substances, such as spatter powder due to welding and screw chips, are often produced during production of an image forming apparatus. Although these foreign metallic substances are cleaned off during production, they are sometimes not sufficiently cleaned off, but remain in the image forming apparatus. Such remaining foreign metallic substances may fall owing to vibration occurring during transport and operation of the image forming apparatus.

In the image forming apparatus in which the above-described foreign-substance receiving plate is provided in the lower part of the rotary developing device, the above-described falling foreign metallic substrates are sometimes received by the foreign-substance receiving plate. Most developing units in the rotary developing device each include a developing roller having a magnet therein to transport developer containing magnetic carriers to a developing position while attracting the developer on a surface of the developing roller. For this reason, if foreign metallic substances are present on the foreign-substance receiving plate in the lower part of the rotary developing device, they are sometimes attached to the developing roller in the developing unit passing over the foreign-substance receiving plate and are carried together with the developer to the developing position. At the developing position, a surface of an image carrier for holding an electrostatic latent image to be developed opposes the developing roller in the developing unit. Hence, if the foreign metallic substances are attached to the developing roller, they may scrape the surface of the image carrier.

SUMMARY

According to an aspect of the invention, there is provided an image forming apparatus including: an image carrier that holds a toner image formed by developing an electrostatic latent image formed thereon with toner; a rotary developing device including a rotation shaft and a plurality of developing units supported on a revolution orbit surrounding the rotation shaft, the rotary developing device developing the electrostatic latent image on the image carrier with the toner by revolving the developing unit used for a current development operation, of the plurality of developing units, to a position opposing the image carrier and supplying the toner from the developing unit opposing the image carrier to the image carrier; a foreign-substance receiving plate that extends along the revolution orbit of the developing units in a lower part of the rotary developing device and receives a falling foreign substance; a transfer unit that transfers the toner image from the image carrier onto a recording medium; and a fixing unit that fixes the toner image transferred by the transfer unit onto the recording medium. Each of the developing units includes a developer container that stores developer containing magnetic carriers and toner electrostatically attached to the magnetic carriers, and a developing roller having a magnet therein, the developing roller supplying the toner in the developer stored in the developer container for development of the electrostatic latent image on the image carrier by transporting the developer to the position opposing the image carrier while attracting the developer on a surface of the image carrier by the magnet. The rotary developing device further supports a foreign-substance collecting member on the revolution orbit on which the plurality of developing units are provided, the foreign-substance collecting member magnetically collecting a magnetic foreign substance on the foreign-substance receiving plate.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below.

First, a first exemplary embodiment will be described.

Figure 1:
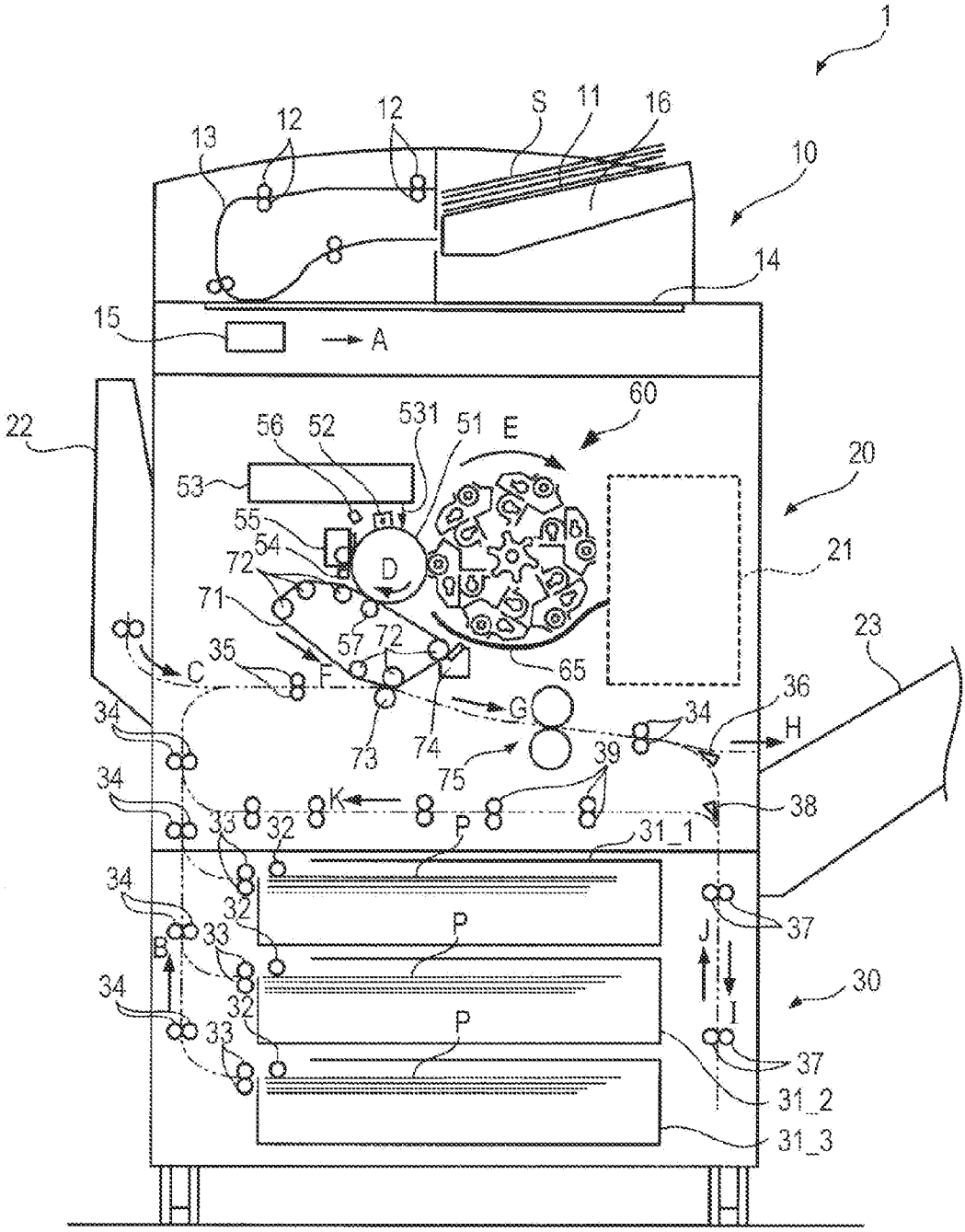
FIG. 1 schematically illustrates a configuration of an image forming apparatus according to a first exemplary embodiment.

FIG. 1 schematically illustrates a configuration of an image forming apparatus 1 according to a first exemplary embodiment.

The image forming apparatus 1 illustrated in FIG. 1 includes a document reading section 10, an image forming section 20, and a paper storage section 30.

The document reading section 10 includes a document feed table 11 on which documents S are stacked. The documents S stacked on the document feed table 11 are fed out one by one, and a fed document S is transported through a transport path 13 by transport rollers 12. Then, characters and images recorded on the transported document S are read by a document reading optical system 15 provided below a document reading plate 14 made of a transparent glass, and the document S is output onto a document output table 16.

A hinge extending in the right-left direction is provided on a back side in the document reading section 10, and the document feed table 11 and the document output table 16 are turned upward together about the hinge. When the document feed table 11 and the document output table 16 are thus turned up, the document reading plate 14 is exposed.

As a reading method adopted in the document reading section 10, instead of placing the documents on the document feed table 11, only one document may be placed upside down on the document reading plate 14, and characters and images may be read from the document on the document reading plate 14 by moving the document reading optical system 15 in a direction of arrow A.

Image signals obtained by the document reading optical system 15 are input to a processing control circuit 21. The processing control circuit 21 forms an image based on the input image signals. The processing control circuit 21 also controls the operations of the units in the image forming apparatus 1.

In the paper storage section 30 provided in a lower part of the image forming apparatus 1, three sheet feeding units 31_1, 31_2, and 31_3 are provided. For example, the sheet feeding units 31_1, 31_2, and 31_3 store stacked sheets P having different sizes. The sheet feeding units 31_1, 31_2, and 31_3 are drawable for the purpose of supply of sheets P.

From a sheet feeding unit that stores sheets P of the size matching the size of the document (here, the sheet feeding unit 31_3 as an example), among these three sheet feeding units 31_1, 31_2, and 31_3, sheets P are fed out by a pickup roller 32. Then, the sheets P are separated one by one by separation rollers 33, and one sheet P is transported upward by transport rollers 34 in a direction of arrow B. Subsequent transport timing of the sheet P is adjusted by standby rollers 35, and the sheet P is then transported further. Transport downstream of the standby rollers 35 will be described below.

The image forming section 20 is equipped with a manual feed tray 22. The manual feed tray 22 is of a folding type that pivots open about a lower end thereof. In the image forming section 20, a sheet placed on the manual feed tray 22 in an open state may be fed in the direction of arrow C.

In the center of the image forming section 20, a photoconductor 51 is provided to rotate in a direction of arrow D. Around the photoconductor 51, a charging unit 52, a rotary developing device 60, a charging controller 54, a cleaner 55, and a charge eliminator 56 are arranged. Above the photoconductor 51, an exposure unit 53 is provided. Also, a transfer unit 57 is provided on a side of a below-described intermediate transfer belt 71 opposite the photoconductor 51.

The photoconductor 51 is cylindrical. The photoconductor 51 stores charge by charging and emits the charge by exposure so as to hold an electrostatic latent image on its surface.

The charging unit 52 charges the surface of the photoconductor 51 to a certain charging potential.

The exposure unit 53 receives image signals from the processing control circuit 21, and outputs a light beam 531 modulated according to the received image signals.

The light beam 531 repeatedly scans a portion of the surface of the photoconductor 51 rotating in the direction of arrow D, which is charged by the charging unit 52, in a rotation axis direction of the photoconductor 51 (a direction perpendicular to the plane of paper of FIG. 1), thereby forming an electrostatic latent image on the surface of the photoconductor 51.

After the electrostatic latent image is formed on the surface of the photoconductor 51 by scanning with the light beam 531, it is developed by the rotary developing device 60 to form a toner image on the surface of the photoconductor 51.

The photoconductor 51 corresponds to an example of an image carrier of the present invention.

The rotary developing device 60 corresponds to an example of a rotary developing device in the image forming apparatus of the present invention. The rotary developing device 60 also corresponds to a rotary developing device according to a first exemplary embodiment of the present invention.

In the rotary developing device 60, four developing units and two dummy developing units, which will be described below, are supported on a revolution orbit surrounding a rotation shaft 61 of the rotary developing device 60. The rotary developing device 60 rotates in a direction of arrow E to revolve the developing units and the dummy developing units around the rotation shaft 61 so that any one of the four developing units is moved to a position opposing the photoconductor 51. An electrostatic latent image formed on the photoconductor 51 is developed into a toner image by the developing unit opposing the photoconductor 51.

The four developing units supported in the rotary developing device 60 contain yellow (Y) toner, magenta (M) toner, cyan (C) toner, and black (K) toner. When developing the electrostatic latent image on the photoconductor 51, the developing unit that contains color toner to be currently used is moved to the position opposing the photoconductor 51. The developing unit opposing the photoconductor 51 performs development with the color toner contained therein.

Below the rotary developing device 60, a catch pan 65 extends along the revolution orbit of the developing units and the dummy developing units. The catch pan 65 receives falling foreign substances such as developer from the developing units and below-described foreign metallic substances. The catch pan 65 corresponds to an example of a foreign-substance receiving plate of the present invention.

Operation of the rotary developing device 60 and the catch pan 65 will be described in detail below with reference to other drawings.

A toner image formed on the photoconductor 51 by development with the developing unit is transferred onto an intermediate transfer belt 71 by the action of the transfer unit 57.

The surface of the photoconductor 51 is charged to a positive polarity by transfer with the transfer unit 57, and a history of the positive polarity is made thereon. After transfer, the history of the positive polarity is removed by the charging controller 54. After the history is removed, toner remaining on the photoconductor 51 after transfer is removed by the cleaner 55, and the charge is eliminated from the photoconductor 51 by the charge eliminator 56.

The intermediate transfer belt 71 is an endless belt stretched on a plurality of rollers 72. The intermediate transfer belt 71 circulates in a direction of arrow F. On a side of a transport path of the sheet P opposite the intermediate transfer belt 71, a transfer unit 73 is provided. On a downstream side of the transfer unit 73 in a circulation direction of the intermediate transfer belt 71, a cleaner 74 is provided to remove toner remaining on the intermediate transfer belt 71 after transfer. The transfer unit 73 and the cleaner 74 are movable closer to and away from the intermediate transfer belt 71. To form a multicolor image, the transfer unit 73 and the cleaner 74 are separated from the intermediate transfer belt 71. Then, a process of forming a toner image of one certain color on the photoconductor 51 and transferring the toner image onto the intermediate transfer belt 71 is repeated corresponding to a plurality of developing units (a plurality of colors of toner) while rotating the rotary developing device 60. Thus, a plurality of toner images of a plurality of color toners are sequentially superimposed and transferred on the intermediate transfer belt 71.

After that, the transfer unit 73 is brought into contact with the intermediate transfer belt 71, and a sheet P is supplied from the standby rollers 35 so as to reach a transfer position, where the transfer unit 73 is located, when the superimposed color toner images reach the transfer position. At the transfer position, the color toner images on the intermediate transfer belt 71 are transferred onto the sheet P by the action of the transfer unit 73. The sheet P on which the toner images are transferred is further transported in a direction of arrow G, and is heated and pressurized by a fixing unit 75, so that an image is formed by the fixed toner images on the sheet P. The fixing unit 75 corresponds to an example of a fixing unit of the present invention.

The above-described catch pan 65 is provided between the rotary developing device 60 and the fixing unit 75, and also serves to prevent heat generated by the fixing unit 75 during fixing from being transmitted to the rotary developing device 60. This prevents the developer in the developing units of the rotary developing device 60 from sticking owing to heat generated during fixing.

The sheet P that has passed through the fixing unit 75 is further transported in a direction of arrow H, and is output onto a sheet output table 23.

The cleaner 74 is also moved into contact with the intermediate transfer belt 71. The cleaner 74 removes residual toner from the intermediate transfer belt 71 after transfer using the transfer unit 73.

The image forming apparatus 1 form images on both surfaces of a sheet P. To form images on both surfaces of the sheet P, after an image is formed on only one surface of the sheet P, the transport direction of the sheet P is switched by a guide member 36, and the sheet P is transported by transport rollers 37 in a direction of arrow I, instead of being output onto the sheet output table 23, as described above. After that, the transport direction is reversed to a direction of arrow J, and the sheet P is transported in a direction of arrow K by being guided by another guide member 38. Then, the sheet P is further transported by transport rollers 39, and reaches the standby rollers 35.

Subsequently, an image is formed on a second surface of the sheet P in a manner similar to the above. The sheet P having images on both surfaces is output onto the sheet output table 23.

Next, the operation of the rotary developing device 60 and the catch pan 65 will be described in detail.

Figure 2:
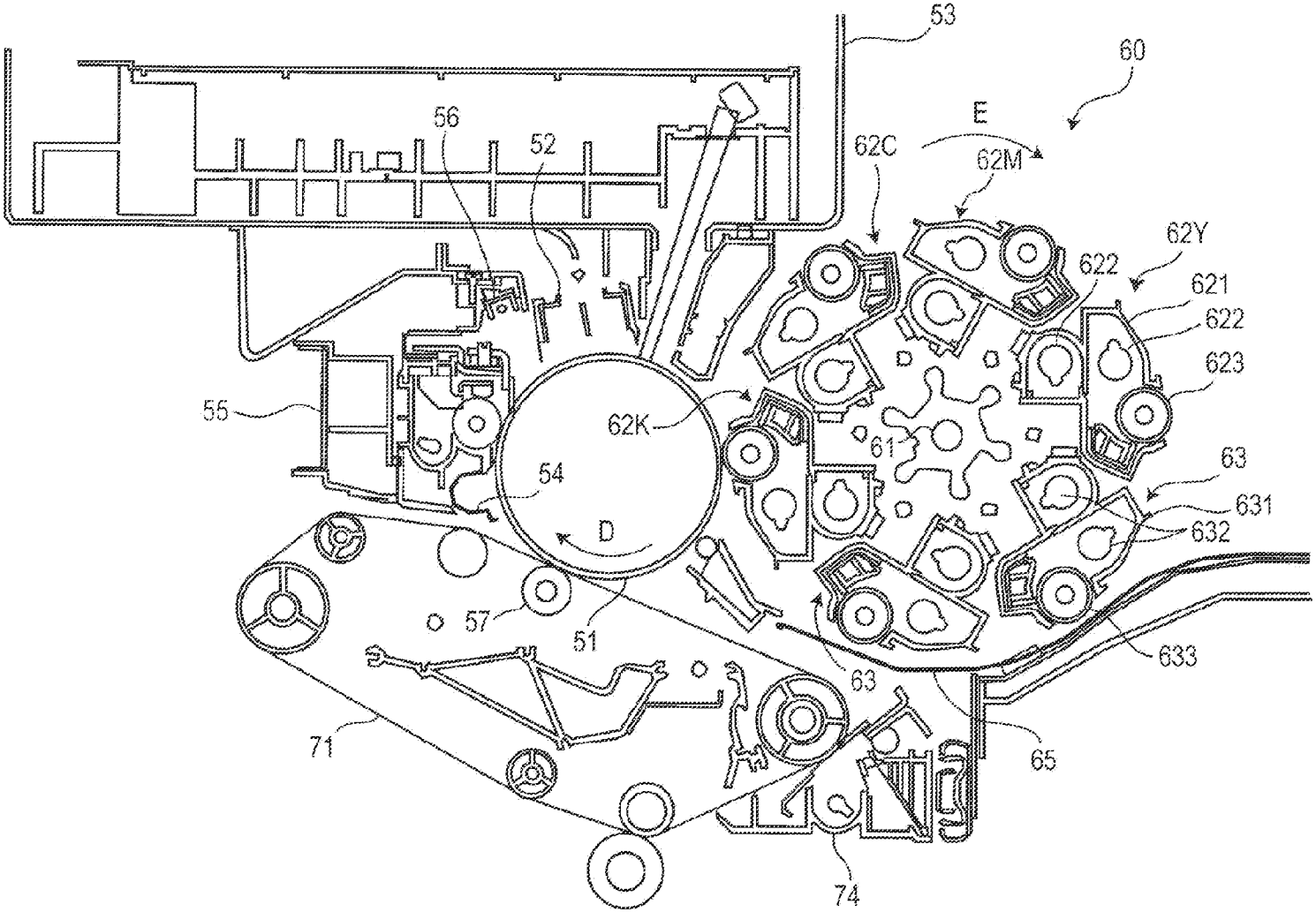
FIG. 2 is an enlarged view of a rotary developing device, a catch pan, and their surroundings illustrated in FIG. 1.

FIG. 2 is an enlarged view of the rotary developing device 60, the catch pan 65, and their surroundings illustrated in FIG. 1.

Besides the rotary developing device 60 and the catch pan 65, FIG. 2 also illustrates the photoconductor 51, the charging unit 52, the exposure unit 53, the charging controller 54, the cleaner 55 for the photoconductor 51, the charge eliminator 56, the intermediate transfer belt 71, and the cleaner 74 for the intermediate transfer belt 71 that are also illustrated in FIG. 1.

In the rotary developing device 60, developing units 62Y, 62M, 62C, and 62K corresponding to four colors Y, M, C, and K are supported on the revolution orbit surrounding the rotation shaft 61. These four developing units 62Y, 62M, 62C, and 62K have the same structure except in the toner to be used. Here, the structure of the developing unit 62Y, of the four developing units 62Y, 62M, 62C, and 62K, will be described as an example.

The developing unit 62Y includes a case 621 that contains developer formed by toner and magnetic carriers. The developing unit 62Y also includes, in the case 621, two augers 622 and a developing roller 623 for carrying the developer to an opposing position opposing the photoconductor 51. In the case 621, the toner is charged by friction against the magnetic carriers while being agitated by the two augers 622. Thus, the toner in the developer is electrostatically attached onto the magnetic carriers.

The developing roller 623 has an unillustrated magnet therein. The developer is attracted toward the developing roller 623 by the magnet and is attached onto a surface of the developing roller 623 in a state in which the toner remains attached to the magnetic carriers. When the rotary developing device 60 rotates in the direction of arrow E to revolve the developing unit 62Y to the opposing position opposing the photoconductor 51, the developing roller 623 of the developing unit 62Y meets the photoconductor 51 at that position. As a result, the developer is carried to the opposing position. The electrostatic latent image on the surface of the photoconductor 51 is developed with the toner in the developer carried to the opposing position.

The four developing units 62Y, 62M, 62C, and 62K supported in the rotary developing device 60 and having the above-described structure correspond to examples of a plurality of developing units of the present invention. Further, the case 621 of each developing unit corresponds to an example of a developer container of the present invention. The developing roller 623 in each developing unit corresponds to an example of a developing roller of the present invention.

Two dummy developing units 63 are further supported in the rotary developing device 60. The dummy developing units 63 are supported on the revolution orbit, where the four developing units 62Y, 62M, 62C, and 62K are located, and between the Y-color developing unit 62Y and the K-color developing unit 62K.

While the dummy developing units 63 are not used for development, they have a structure equivalent to the structure of the developing units 62Y, 62M, 62C, and 62K. That is, each of the dummy developing units 63 also includes a case 631, two augers 632, and a developing roller 633 having a magnet therein. However, the case 631 of the dummy developing unit 63 does not contain developer, and the two augers 632 and the developing roller 633 move idly. Further, the position of the developing roller 633 in the dummy developing unit 63 is slightly closer to the inner side of the case 631 than the position of the developing roller in the developing unit used for development. The position of the developing roller 633 in the dummy developing unit 63 will be described in detail below.

In general, foreign metallic substances, such as spatter powder due to welding and screw chips, are frequently produced during production of an image forming apparatus. Although these foreign metallic substances are cleaned off during production, they are sometimes not sufficiently cleaned off, but remain in the image forming apparatus. Such remaining foreign metallic substances may fall owing to vibration occurring during transport and operation of the image forming apparatus.

In the image forming apparatus 1 of the first exemplary embodiment, the catch pan 65 is provided below the rotary developing device 60. The catch pan 65 receives developer from the rotary developing device 60 and the above-described falling foreign metallic substances.

Supposing foreign metallic substances received by the catch pan 65 are magnetically attracted by the developing roller of the developing unit in the rotary developing device 60 and are attached to the surface of the developing roller, the developing roller may scrape the surface of the photoconductor 51 when opposing the photoconductor 51 during development.

In the first exemplary embodiment, the developing rollers 633 with the magnets in the two dummy developing units 63 provided in the rotary developing device 60 serve to magnetically collect foreign metallic substances on the catch pan 65. The dummy developing units 63 correspond to an example of a foreign-substance collecting member of the present invention. The dummy developing units 63 also correspond to an example of a dummy developing unit of the present invention.

Since each dummy developing unit 63 in the rotary developing device 60 has a structure equivalent to the structure of the developing units used for development, a support structure for the dummy developing unit 63 is also equivalent to a support structure for the developing units used for development. For this reason, if image formation is performed using some special color in addition to the four colors Y, M, C, and K in future, the dummy developing unit 63 may be replaced with a developing unit for the special color.

In addition, in the first exemplary embodiment, a home position where the rotary developing device 60 stays from when an operation is completed and to when the next operation starts is set as follows. That is, in the first exemplary embodiment, the home position of the rotary developing device 60 is set at a position where the two dummy developing units 63 oppose the catch pan 65. For this reason, in the first exemplary embodiment, operation of the rotary developing device 60 is started in a state in which foreign metallic substances on the catch pan 65 are collected by the dummy developing units 63.

FIG. 2 illustrates the rotary developing device 60 located at the home position.

The home position is not limited to the position where the dummy developing units 63 oppose the catch pan 65 as in the first exemplary embodiment. The home position may be a position where the dummy developing units 63 are located on an upstream side of the position opposing the catch pan 65 in the rotating direction of the rotary developing device 60. In this case, however, the dummy developing units 63 are positioned on the above-described upstream side so that the K-color developing unit 62K downstream of the dummy developing units 63 does not oppose the catch pan 65. That is, in this case, the home position is a position where the dummy developing units 63 meets the catch pan 65 earlier than any of the developing units used for development after operation of the rotary developing device 60 starts.

The rotary developing device 60 starts rotation from the above-described home position, and temporarily stops every time any of the developing units 62Y, 62M, 62C, and 62K and the dummy developing units 63 meets the photoconductor 51.

When the rotary developing device 60 stops at the position where any of the developing units 62Y, 62M, 62C, and 62K opposes the photoconductor 51, toner is supplied from the opposing developing unit to the photoconductor 51 to develop an electrostatic latent image. After stopping for a predetermined development time, the rotary developing device 60 restarts rotation.

When the rotary developing device 60 stops at the position where any of the two dummy developing units 63 opposes the photoconductor 51, the developing rollers 633 in the dummy developing units 63 move idly. In this case, the rotary developing device 60 also restarts rotation after stopping for the above-described development time.

In this way, the rotary developing device 60 repeats the operations of temporarily stopping every time any developing unit meets the photoconductor 51 and restarting rotation, and then stops at the home position again.

In the first exemplary embodiment, when the rotary developing device 60 performs the first operation after power-on of the image forming apparatus 1, it rotates while switching the rotation speed as follows.

For example, the first operation after power-on refers to the first operation after power-on of the image forming apparatus 1 that has been subjected to handling such as transport associated with vibration which easily causes fall of foreign metallic substances in the image forming apparatus 1. In the first operation, a lot of foreign metallic substances may exist on the catch pan 65. The below-described switch of the rotation speed is performed on the assumption of such possibility.

In the first operation, the rotary developing device 60 rotates at a first rotation speed from when it starts rotation from the home position to when any of the four developing units 62Y, 62M, 62C, and 62K first meets the photoconductor 51. The first rotation speed is lower than a second rotation speed at which the rotary developing device 60 rotates until it stops at the home position again after the developing unit first meets the photoconductor 51.

In the first exemplary embodiment, while the rotary developing device 60 starts rotation from the home position and rotates at the lower first rotation speed, the two dummy developing units 63 slowly pass over the catch pan 65. Thus, even if there are a lot of foreign metallic substances on the catch pan 65, the foreign metallic substances are collected over time by the slowly moving dummy developing units 63.

After any of the developing units first meets the photoconductor 51, the rotation speed is switched to the higher second rotation speed, and the rotary developing device 60 rotates at the second rotation speed for development.

In the second and subsequent operations, the rotary developing device 60 starts rotation from the home position, and consistently rotates at the second rotation speed until it returns to the home position again.

The above-described rotating operation of the rotary developing device 60 is performed according to instructions from the processing control circuit 21 illustrated in FIG. 1.

Instead of being performed in the first operation after power-on as in the first exemplary embodiment, for example, the above-described switching of the rotation speed of the rotary developing device 60 may be performed every time rotation starts from the home position after power-on. Alternatively, such switching of the rotation speed may be performed in the first operation after an event different from power-on, such as replacement of the development unit, occurs, or may be performed every time rotation starts from the home position after the event.

As described above, the developing roller 633 in each dummy developing unit 63 is slightly closer to the inner side of the case 631 than the developing roller in the developing unit used for development. As a result, an opposing distance between the developing roller 633 in the dummy developing unit 63 and the photoconductor 51 when the developing roller 633 opposes the photoconductor 51 is longer than an opposing distance between the developing roller in the developing unit used for development and the photoconductor 51 when the developing roller opposes the photoconductor 51.

Figure 3A:
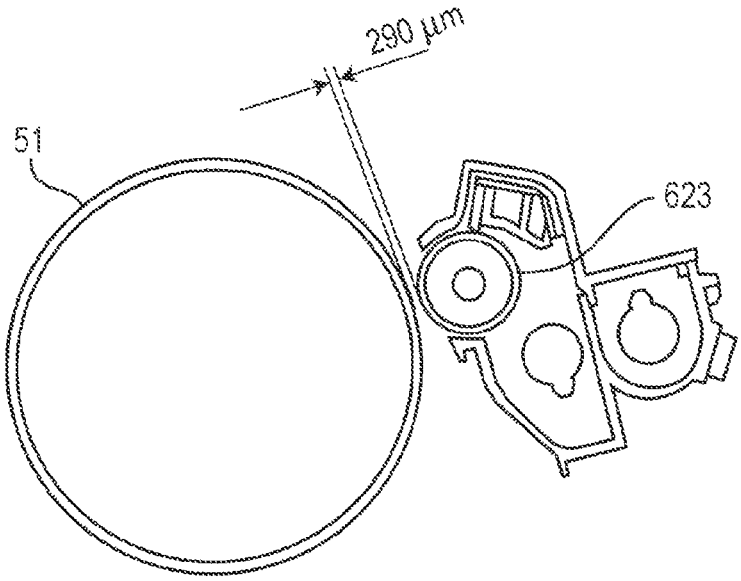
FIGS. 3A and 3B respectively illustrate an opposing distance between a photoconductor and a developing roller in a developing unit used for development, and an opposing distance between the photoconductor and a developing roller in a dummy developing unit.
Figure 3B:
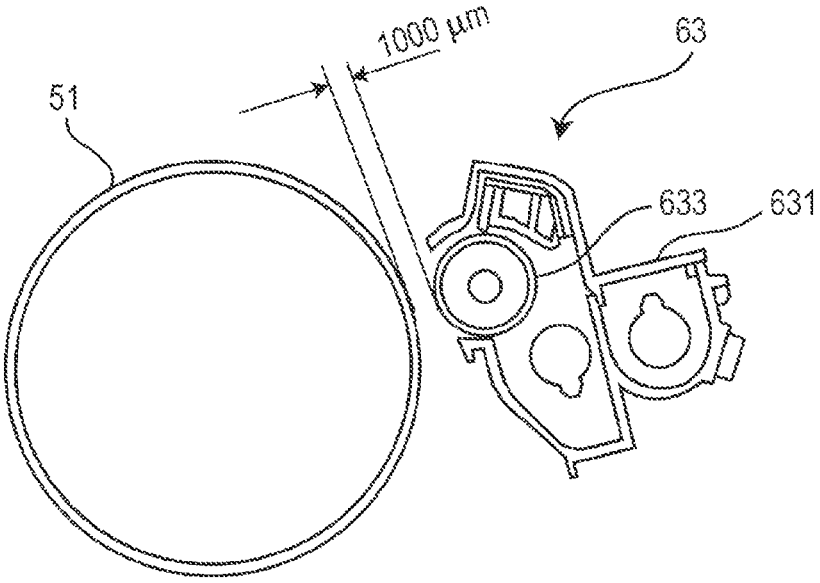

FIGS. 3A and 3B respectively illustrate the opposing distance between the photoconductor and the developing roller in the developing unit used for development and the opposing distance between the photoconductor and the developing roller in the dummy developing unit.

FIG. 3A illustrates the opposing distance between the photoconductor 51 and the developing roller 623 in the developing unit used for development. As illustrated in FIG. 3A, the developing roller 623 is located at a position in the case such that the opposing distance is 290 μm. The opposing distance of 290 μm allows the toner to be smoothly transferred from the developing unit onto the photoconductor 51.

FIG. 3B illustrates the opposing distance between the photoconductor 51 and the developing roller 633 in the dummy developing unit 63. As illustrated in FIG. 3B, in the dummy developing unit 63, the developing roller 633 is located at a position in the case 631 such that the opposing distance is 1000 μm. The position of the developing roller 633 in the case 631 of the dummy developing unit 63 is closer by 710 μm to the inner side of the case 631 than the position of the developing roller in the developing unit used for development.

In the first embodiment, it is assumed that foreign metallic substances remaining without being completely cleaned off during production of the image forming apparatus 1 have a size less than 1000 μm.

In the first exemplary embodiment, the opposing distance between the photoconductor 51 and the developing roller 633 in the dummy developing unit 63 is set to be 1000 μm so that foreign metallic substances of the assumed size sufficiently separate from the surface of the photoconductor 51.

In the first exemplary embodiment, since the developing roller 633 in the dummy developing unit 63 is located closer to the inner side of the case 631, the opposing distance between the photoconductor 51 and the developing roller 633 is longer than the opposing distance between the photoconductor 51 and the developing roller in the developing unit used for development. However, the opposing distance between the photoconductor and the developing roller in the dummy developing unit is not increased only by shifting the developing roller to the inner side of the case as in the first exemplary embodiment. For example, the opposing distance may be increased by setting the diameter of the developing roller in the dummy developing unit to be less than the diameter of the developing roller in the developing unit used for development.

Next, a second exemplary embodiment will be described.

The second exemplary embodiment is equivalent to the first exemplary embodiment except that a member for collecting foreign metallic substances is different from the above-described dummy developing units 63. The second exemplary embodiment will be described below with attention to differences from the first exemplary embodiment. Since an overall configuration of an image forming apparatus according to the second exemplary embodiment is equivalent to that of the image forming apparatus 1 of the first exemplary embodiment, illustration and description thereof are skipped.

Figure 4:
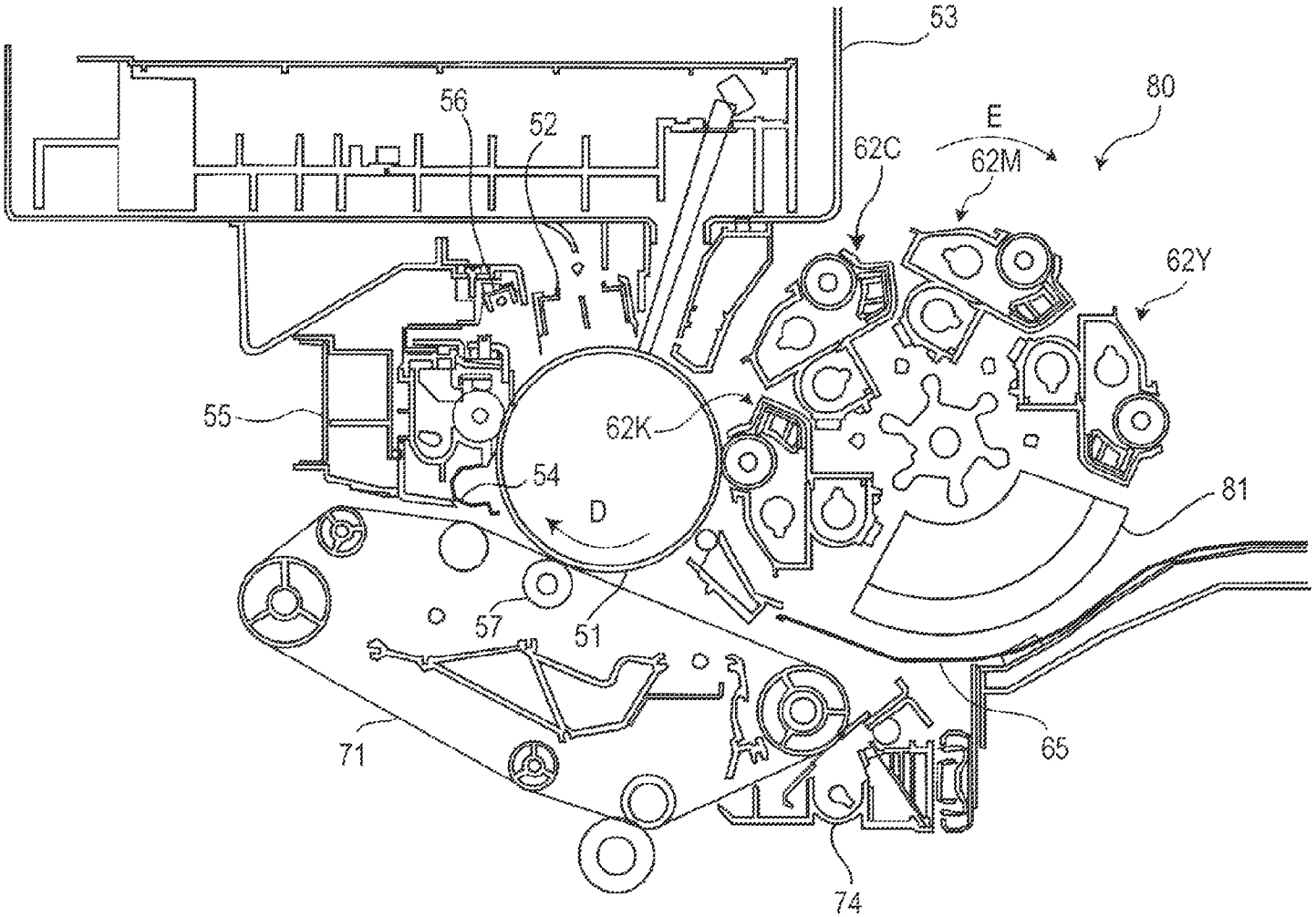
FIG. 4 is an enlarged view of a rotary developing device, a catch pan, and their surroundings in an image forming apparatus according to a second exemplary embodiment.

FIG. 4 is an enlarged view of a rotary developing device 80, a catch pan 65, and their surroundings in the image forming apparatus of the second exemplary embodiment.

In FIG. 4, constituents equivalent to the constituents of the image forming apparatus 1 of the first exemplary embodiment illustrated in FIG. 2 are denoted by the same reference numerals as those in FIG. 2. Hereinafter, redundant descriptions of the equivalent constituents are skipped.

In the rotary developing device 80 of the second exemplary embodiment, a permanent magnet 81 is supported on a revolution orbit on which four developing units 62Y, 62M, 62C, and 62K are provided, and between the Y-color developing unit 62Y and the K-color developing unit 62K. In the second exemplary embodiment, the permanent magnet 81 has magnetism that is strong to an extent such as not to hinder the operation of the rotary developing device 80 by magnetic interference with peripheral metal structures. In the second exemplary embodiment, the permanent magnet 81 thus having strong magnetism collects foreign metallic substances on the catch pan 65.

The permanent magnet 81 is supported at a position such that an opposing distance between the permanent magnet 81 and a photoconductor 51 is longer than an opposing distance between developing rollers in the developing units and the photoconductor 51.

The permanent magnet 81 also corresponds to an example of a foreign-substance collecting member of the present invention. The permanent magnet 81 further corresponds to an example of a permanent magnet of the present invention.

In the second exemplary embodiment, a home position of the rotary developing device 80 is set at a position where the permanent magnet 81 opposes the catch pan 65.

The home position is not limited to the position where the permanent magnet 81 opposes the catch pan 65 as in the second exemplary embodiment. The home position may be a position where the permanent magnet 81 meets the catch pan 65 earlier than any of the developing units after the rotary developing device 80 starts operation.

In the second exemplary embodiment, the operation of the rotary developing device 80 starts in a state in which foreign metallic substances on the catch pan 65 are collected by the permanent magnet 81. Further, in the second exemplary embodiment, the rotary developing device 80 also rotates while switching the rotation speed in a first operation after power-on, similarly to the rotary developing device 60 of the first exemplary embodiment.

While the color copying machine 1 is given as an example of an image forming apparatus in the above-described first and second exemplary embodiments, the image forming apparatus may be, for example, a color printer or a color facsimile machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that holds a toner image formed by developing an electrostatic latent image formed thereon with toner;

a rotary developing device including a rotation shaft and a plurality of developing units supported on a revolution orbit surrounding the rotation shaft, the rotary developing device developing the electrostatic latent image on the image carrier with the toner by revolving the developing unit used for a current development operation, of the plurality of developing units, to a position opposing the image carrier and supplying the toner from the developing unit opposing the image carrier to the image carrier;

a foreign-substance receiving plate that extends along the revolution orbit of the developing units in a lower part of the rotary developing device and receives a falling foreign substance;

a transfer unit that transfers the toner image from the image carrier onto a recording medium; and a fixing unit that fixes the toner image transferred by the transfer unit onto the recording medium, wherein each of the developing units includes a developer container that stores developer containing magnetic carriers and toner electrostatically attached to the magnetic carriers, and a developing roller having a magnet therein, and the developing roller supplies the toner in the developer stored in the developer container for development of the electrostatic latent image on the image carrier by transporting the developer to the position opposing the image carrier while attracting the developer on a surface of the image carrier by the magnet, and wherein the rotary developing device further supports a foreign-substance collecting member on the revolution orbit on which the plurality of developing units are provided, and the foreign-substance collecting member magnetically collects a magnetic foreign substance on the foreign-substance receiving plate.

2. The image forming apparatus according to claim 1, wherein the rotary developing device has a home position to stop between a completion of an operation and a start of the next operation at a position where the foreign-substance collecting member opposes the foreign-substance receiving plate or meets the foreign-substance receiving plate earlier than any of the plurality of developing units after the operation starts.

3. The image forming apparatus according to claim 2, wherein the rotary developing device makes one revolution while repeating an operation of starting rotation from the home position and temporarily stopping every time any of the plurality of developing units meets the image carrier, and then restarting rotation, and stops again at the home position after the revolution, and wherein, in at least the first operation after a specific event, a rotation speed of the rotary developing device made from when the rotary developing device starts rotation from the home position to when the first developing unit to meet the image carrier, of the plurality of developing units, meets the image carrier is lower than a rotation speed made until the rotary developing device stops at the home position again after the first developing unit meets the image carrier.

4. The image forming apparatus according to claim 1, wherein the rotary developing device supports the foreign-substance collecting member at a position where an opposing distance between the image carrier and the foreign-substance collecting member is longer than an opposing distance between the image carrier and the developing roller in each of the plurality of developing units.

5. The image forming apparatus according to claim 2, wherein the rotary developing device supports the foreign-substance collecting member at a position where an opposing distance between the image carrier and the foreign-substance collecting member is longer than an opposing distance between the image carrier and the developing roller in each of the plurality of developing units.

6. The image forming apparatus according to claim 3, wherein the rotary developing device supports the foreign-substance collecting member at a position where an opposing distance between the image carrier and the foreign-substance collecting member is longer than an opposing distance between the image carrier and the developing roller in each of the plurality of developing units.

7. The image forming apparatus according to claim 1, wherein the rotary developing device supports, as the foreign-substance collecting member, a dummy developing unit that has a structure similar to a structure of the developing units and that is not used for development.

8. The image forming apparatus according to claim 2, wherein the rotary developing device supports, as the foreign-substance collecting member, a dummy developing unit that has a structure similar to a structure of the developing units and that is not used for development.

9. The image forming apparatus according to claim 3, wherein the rotary developing device supports, as the foreign-substance collecting member, a dummy developing unit that has a structure similar to a structure of the developing units and that is not used for development.

10. The image forming apparatus according to claim 4, wherein the rotary developing device supports, as the foreign-substance collecting member, a dummy developing unit that has a structure similar to a structure of the developing units and that is not used for development.

11. The image forming apparatus according to claim 5, wherein the rotary developing device supports, as the foreign-substance collecting member, a dummy developing unit that has a structure similar to a structure of the developing units and that is not used for development.

12. The image forming apparatus according to claim 6, wherein the rotary developing device supports, as the foreign-substance collecting member, a dummy developing unit that has a structure similar to a structure of the developing units and that is not used for development.

13. The image forming apparatus according to claim 1, wherein the rotary developing device supports a permanent magnet as the foreign-substance collecting member.

14. The image forming apparatus according to claim 2, wherein the rotary developing device supports a permanent magnet as the foreign-substance collecting member.

15. The image forming apparatus according to claim 3, wherein the rotary developing device supports a permanent magnet as the foreign-substance collecting member.

16. The image forming apparatus according to claim 4, wherein the rotary developing device supports a permanent magnet as the foreign-substance collecting member.

17. The image forming apparatus according to claim 5, wherein the rotary developing device supports a permanent magnet as the foreign-substance collecting member.

18. The image forming apparatus according to claim 6, wherein the rotary developing device supports a permanent magnet as the foreign-substance collecting member.

19. A rotary developing device comprising:

a rotation shaft; and a plurality of developing units supported on a revolution orbit surrounding the rotation shaft, wherein the rotary developing device develops an electrostatic latent image on an image carrier with toner by revolving the developing unit used for a current development operation, of the plurality of developing units, to a position opposing the image carrier and supplying the toner from the developing unit opposing the image carrier to the image carrier, and the image carrier holds a toner image formed by developing the electrostatic latent image with the toner, wherein each of the developing units includes a developer container that stores developer containing magnetic carriers and toner electrostatically attached to the magnetic carriers, and a developing roller having a magnet therein, and the developing roller supplies the toner in the developer stored in the developer container for development of the electrostatic latent image on the image carrier by transporting the developer to the position opposing the image carrier while attracting the developer on a surface of the image carrier by the magnet, and wherein the rotary developing device further supports a foreign-substance collecting member on the revolution orbit on which the plurality of developing units are provided, and the foreign-substance collecting member magnetically collects a magnetic foreign substance on a foreign-substance receiving plate extending along the revolution orbit of the developing units in a lower part of the rotary developing device to receive a falling foreign substance.

* * * * *